United States Patent [19]

Belokin

[11] Patent Number: 4,488,653

[45] Date of Patent: Dec. 18, 1984

[54] MAGNETICALLY MOUNTED SHELF DIVIDER

[76] Inventor: Paul Belokin, P.O. Box 1907, Denton, Tex. 76201

[21] Appl. No.: 588,238

[22] Filed: Mar. 12, 1984

[51] Int. Cl.[3] ..... A47F 5/10

[52] U.S. Cl. ..... 211/184; 108/61; 211/DIG. 1; 248/206.5; 248/DIG. 9

[58] Field of Search ..... 211/184, 43, DIG. 1, 211/490, 94, 162; 108/60, 61; 248/DIG. 9, 206.5

[56] References Cited

U.S. PATENT DOCUMENTS

| | | | |
|---|---|---|---|
| 2,222,190 | 11/1940 | Wolf | 211/43 X |
| 2,516,122 | 7/1950 | Hughes | 211/184 |
| 3,339,746 | 9/1967 | McCabe | 211/184 X |
| 4,212,506 | 7/1980 | Merl | 108/61 X |
| 4,364,481 | 12/1982 | Ricci | 211/184 |

FOREIGN PATENT DOCUMENTS

| | | | |
|---|---|---|---|
| 1050490 | 3/1979 | Canada | 211/184 |

*Primary Examiner*—Robert W. Gibson, Jr.
*Attorney, Agent, or Firm*—James E. Nilles

[57] ABSTRACT

The partitioning shelf divider of this invention, for perforated and imperforate metal shelving, comprises an inverted T-shaped divider member and a retainer member extruded from elastomeric material impregnated with a magnetized medium. The retainer member has an upwardly opening groove in its top, extending along its length and of inverted T-shaped cross-section, in which the bottom of the divider member is lengthwise slidably received.

4 Claims, 7 Drawing Figures

MAGNETICALLY MOUNTED SHELF DIVIDER

FIELD OF THE INVENTION

This invention relates to point of sale display equipment and is more particularly concerned with a partition-like shelf divider which can be readily shifted to any desired position on a display shelf but which resists displacement out of any position in which it is placed, even after being shifted many times.

BACKGROUND OF THE INVENTION

When merchandise is displayed on shelves for retail sale or the like, it is desirable for various kinds and brands of merchandise on a particular shelf to be separated by means of partitioning dividers that extend from front to rear across the width of the shelf. Shelf dividers serve to allocate a specific area of shelf to each line of merchandise, ensuring that every competing brand will have its fair share of the available shelf space. They encourage neat stocking of the shelves and orderly, attractive display of the merchandise that facilitates selection by the customer and promotes sales.

To be satisfactory, a shelf divider should be as thin as possible in order to occupy a minimum amount of shelf area. Obviously it should also be very inexpensive. Satisfying these requirements implies that it will also be very light in weight. Nevertheless, once in place on a shelf, a shelf divider should securely resist inadvertent displacement. However, merchandise display arrangements are changed rather frequently, to stimulate customer interest and to keep up with product changes and changing demands; and therefore deliberate shifting of a shelf divider should be quickly and easily accomplished.

U.S. Pat. No. 2,780,876 discloses an adjustable shelf divider having transversely extending flanges at its opposite ends that engage against the front and rear edges of a shelf on which the divider is installed. Among other limitations, such a device is not suitable for installation on a shelf that has its rear edge engaged against, or very close to, a wall or upright partition. Each of U.S. Pat. Nos. 3,954,184 and 4,181,229 discloses a shelf divider intended for cooperation with a perforated shelf, having securement portions which project down into the holes in the shelf and which preclude installation of the device on imperforate shelving. These prior patents demonstrate that another requirement for a satisfactory shelf divider is suitability for installation on both perforated and imperforate shelving, however arranged.

U.S. Pat. No. 4,364,481 discloses a so-called shelf organizer which functions to partition a shelf on which it is installed and which is held in place by an adhesive coating on its bottom. Even if the coating is a permanently tacky material, the device can be shifted no more than a few times before it refuses to stick. Another disadvantage of securement by means of a tacky material is the ever-present possibility of the material stripping off of the device and sticking to the shelf, requiring an annoying cleaning operation.

SUMMARY OF THE INVENTION

Having in mind the deficiencies of prior shelf dividers and the several apparently incompatible requirements that must be met in a satisfactory shelf divider, the general object of this invention is to provide a low cost but attractive shelf divider that occupies negligible shelf space, is capable of being installed with practically no effort, is suitable for both perforated and imperforate metal shelving, and is capable of being instantly shifted from place to place on a shelf but is nevertheless able to resist inadvertent displacement out of any position in which it may be placed although not dependent upon a tacky or adhesive material for its securement.

Another and more specific object of the invention is to provide a shelf divider of the above described character that is readily adaptable to installation on a shelf of any of a wide range of widths.

It is also a specific object of this invention to provide a shelf divider of the character described that has a substantially upright display member at its front end on which a brand name, price information or the like can be displayed in association with merchandise adjacent to the shelf divider.

In general, these and other objects of the invention that will appear as the description proceeds are achieved on a partitioning shelf divider of this invention, for a shelf of magnetically permeable material, which is characterized by an elongated divider member having an inverted T-shaped cross-section along a substantially major portion of its length, with an upright partition web and a pair of supporting flanges that project laterally in opposite directions from the bottom of said partition web. The shelf divider further comprises an elongated retainer member of elastomeric material impregnated with magnetized material, having opposite straight and parallel side edges and having a transverse cross-section which is uniform along its length, with a substantially flat bottom surface, a substantially upwardly facing surface area that is spaced laterally inwardly from each of said side edges, and a pair of retaining flanges that project edgewise laterally toward one another over said surface area, each of which closely overlies one of said supporting flanges to confine it against said surface area, said retaining flanges having adjacent free edges that are spaced apart to receive between them said partition web of the divider member.

BRIEF DESCRIPTION OF DRAWINGS

In the accompanying drawings, which illustrate what are now regarded as preferred embodiments of the invention.

DETAILED DESCRIPTION OF PREFERRED EMBODIMENTS OF THE INVENTION

Figure 1:
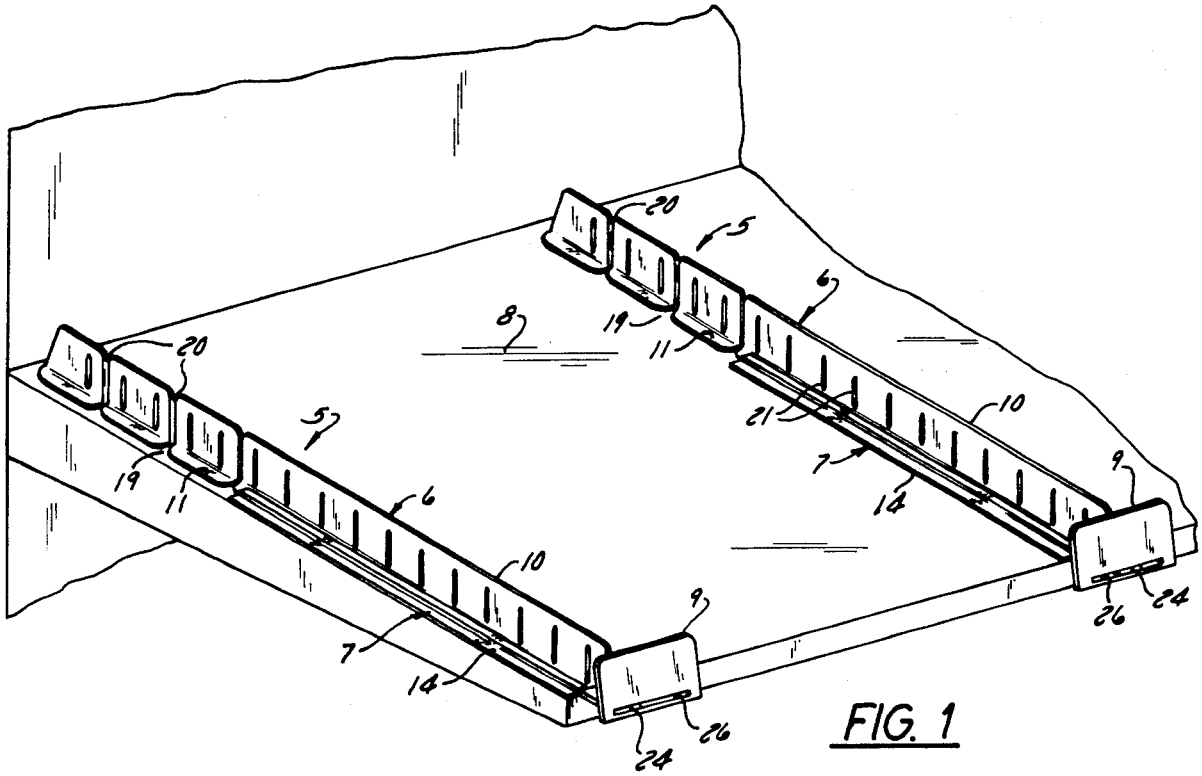
FIG. 1 is a perspective view of a pair of shelf dividers embodying the principles of this invention, installed on a shelf to define an area of it that is allocated to particular items of merchandise.

A shelf divider 5 that embodies the principles of this invention comprises, in general, an elongated divider member 6 that is preferably molded of plastic, and an elongated retainer member 7 to which the divider member 6 is lengthwise adjustably connected and which serves to releasably secure the divider member to a shelf 8 and to hold the divider member in its upright position. Preferably the shelf divider 5 also comprises a plate-like substantially upright display member 9 that is secured to the front end of the divider member 6 and extends transversely to its length.

Along a substantially major portion of its length the divider member 6 is of inverted T-shaped cross-section, having an edgewise upright partition web 10 and a pair of supporting flanges 11 that project laterally in opposite directions from the bottom of the web 10. The partition web 10, which is substantially strip-like, can be of any desired height. Preferably its height is uniform all along its length, as here shown, but it does not have to have a straight top edge. However, the supporting flanges 11, which are preferably of like widths, have their laterally outer edges straight and parallel to one another along a substantially major portion of the length of the divider member. As shown, the bottom surfaces of supporting flanges 11 are coplanar.

The retainer member 7, which is made of an elastomer that is impregnated with magnetized material, has a cross-section that is uniform all along its length and therefore it can be produced as an extrusion. It has the form of a strip-like base portion 14 from which inverted L-shaped retaining flanges 15 project upwardly and laterally inwardly. The vertical legs 16 of the L-shaped retaining flanges 15 are spaced laterally inwardly from the side edges of the base portion 14 and are spaced from one another by a distance such that the supporting flanges 11 of the divider member can be closely received between them. The horizontal legs 17 of the retaining flanges, which project laterally inwardly from the respective vertical legs 16, are spaced above the base portion 14 of the retainer member to closely overlie the supporting flanges 11 and more or less clampingly confine them against a flat top surface area 13 of the base portion that is between the vertical legs 16. The adjacent laterally inner edges of the retaining flanges 15 are spaced apart by a distance at least great enough for the upright partition web 10 of the divider member to be received between them.

It will be apparent that the divider member 6 is simply slid endwise into assembled relationship with the retainer member 7. Furthermore, because of the resilience of the elastomeric retainer member 7, its retaining flanges 15 and base portion 14 can very closely embrace the supporting flanges 11 of the divider member to provide a secure connection between the members which, however, leaves them readily adjustable lengthwise relative to one another.

To provide a stable support for the divider member 6 that resists flatwise tilting of its upright partition web 10, the width of the base portion 14 of the retainer number is substantially greater than the width of the divider member across its supporting flanges 11. Thus, laterally outwardly of the flanges 15 the base portion 14 of the retainer member is thin and flat, and therefore relatively supple so that it can conform itself to slight irregularities in the top surface of a metal shelf 8 that it overlies.

Because the retainer member 7 is impregnated with magnetized material, it clings magnetically to a steel shelf such as is almost invariably used for displaying merchandise. Furthermore such magnetic attachment occurs over substantially the whole of the bottom surface of the retainer member 7, on an apertured shelf as well as on an imperforate one, and therefore the retainer member provides an effectively rigid support for the divider member 6, notwithstanding its own substantial suppleness. Although resisting displacement out of any position in which it is established, the retainer member can of course be shifted to a new position very easily.

The retainer member 7 is preferably somewhat shorter than the divider member 6, and the divider member is preferably so formed that rear portions of it can be readily broken off in modular-length segments, to accommodate the device to a shelf of any of a wide range of widths. To this end, each of the supporting flanges 11 of the divider member is interrupted along its length, at regular intervals along its rear portion, by notches 19, each of which extends laterally outwardly through it from the partition web 10. Each such notch 19 in one supporting flange is laterally in line with a similar notch in the other one. In addition, the upright partition web 10 has a groove 20 in each of its side surfaces, in line with each pair of notches 19 and extending lengthwise through its full height, and these grooves 20 define a line of reduced thickness at which the divider member is easily broken by simply bending it back and forth.

Preferably the upright partition web 10 is formed with vertical ribs 21 on both of its side surfaces, at regular intervals along its length. These not only increase its stiffness and enhance its appearance but also serve the practical function of resisting shifting of merchandise adjacent to the device.

Figure 2:
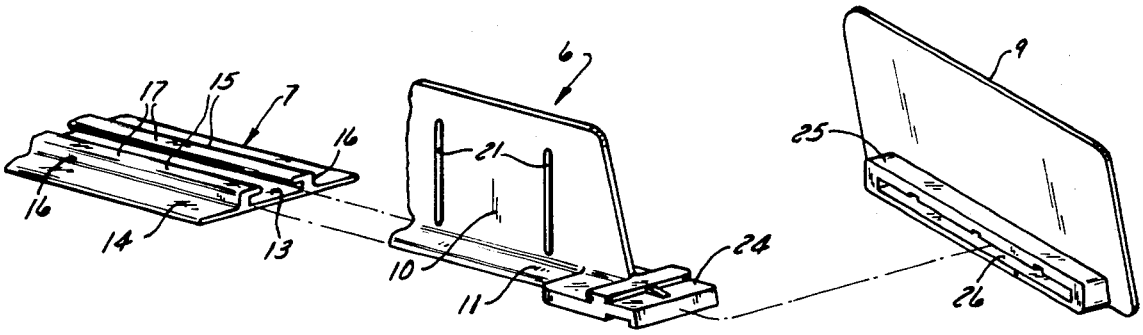
FIG. 2 is a fragmentary disassembled perspective view of the shelf divider of this invention.
Figure 3:
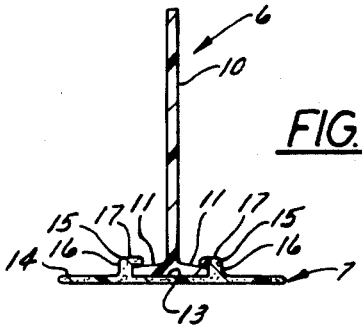
FIG. 3 is a view of the shelf divider in cross-section.
Figure 5:
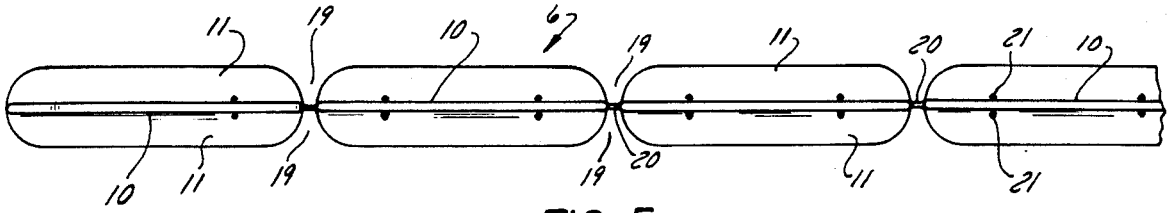
FIG. 5 is a top view of the portion of the divider member shown in FIG. 4.
Figure 4:
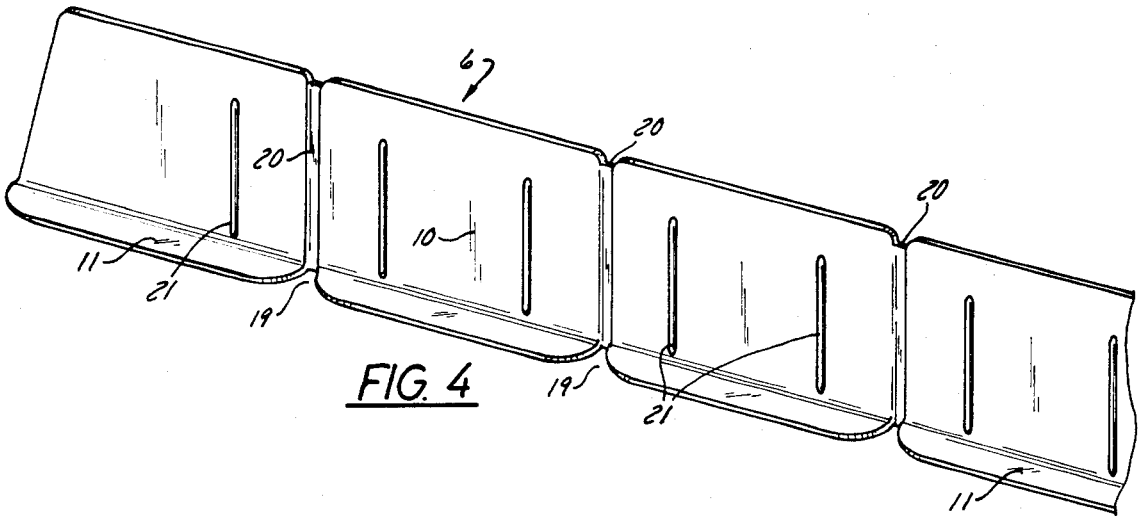
FIG. 4 is a side perspective view of the rear portion of the divider member.
Figure 6:
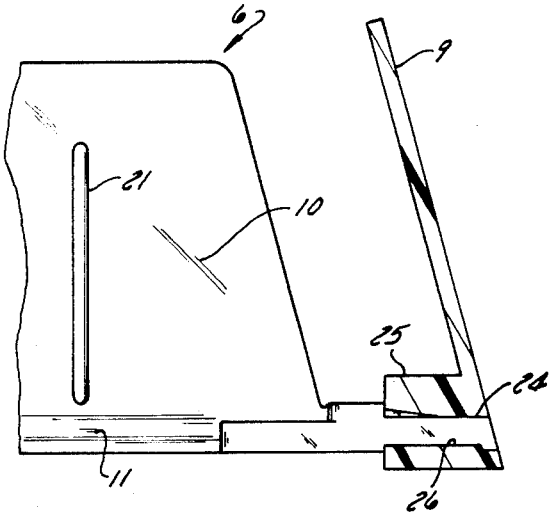
FIG. 6 is a view in side elevation of the front end portion of the shelf divider with the display member attached.
Figure 7:
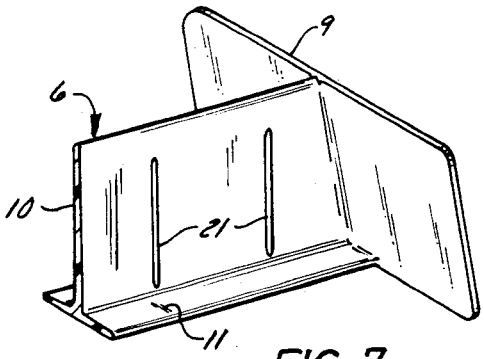
FIG. 7 is a side perspective view of the front end portion of a modified embodiment of the shelf divider of this invention.

The flat, upright display member 9, which extends transversely across the front end of the divider member 6, serves for displaying a brand name, price information or the like. As shown in FIG. 7, the display member 9 can have a flat rear surface that is directly bonded, as by means of a suitable cement, to coplanar front end edges of the partition web 10 and the supporting flanges 11. Alternatively, as shown in FIGS. 2 and 6 and as is preferred, a horizontal tongue 24, comprising an extension of the supporting flanges 11, projects forwardly beyond the partition web 10, and the display member 9 has a rearwardly projecting boss portion 25 at its bottom that defines a horizontally elongated rearwardly opening groove or slot 26 in which the tongue 24 is snugly receivable. The length of the groove 26, as measured transversely to the divider member, can be substantially equal to the width of the tongue 24, or it can be about three times the width of the tongue, as shown, so that the display member can be adjustably shifted to be centered across the partitioning member or to project substantially to one side or to the other of it.

From the foregoing description taken with the accompanying drawings it will be apparent that this invention provides a very inexpensive but attractive partitioning shelf divider, capable of being installed in an instant on perforate or imperforate metal shelving and capable of being instantly shifted from place to place on a shelf but nevertheless capable of resisting inadvertent displacement out of any position in which it may be placed.

What is claimed as the invention is:

1. A shelf divider for a shelf of magnetically permeable metal, comprising:

A. an elongated divider member having an inverted T-shaped cross-section along a substantially major portion of its length, with (1) an upright partition web and (2) a pair of supporting flanges that project laterally in opposite directions from the bottom of said partition web; and B. an elongated retainer member of an elastomeric material impregnated with magnetized material, having opposite straight and parallel side edges and having a transverse cross-section which is uniform along its length, with (1) a substantially flat bottom surface, (2) a substantially upwardly facing surface area that is spaced laterally inwardly from each of said side edges, and (3) a pair of retaining flanges that project edgewise laterally toward one another over said surface area, each of which closely overlies one of said supporting flanges to confine it against said surface area, said retaining flanges having adjacent free edges that are spaced apart to receive between them said partition web of the divider member.

2. The shelf divider of claim 1 wherein said divider member is substantially longer than said retainer member, further characterized by:

(1) each of said supporting flanges being interrupted along its length by a notch therein that extends laterally outwardly from the partition web and is laterally opposite a similar notch in the other supporting flange; and (2) said partition having a groove therein aligned with each said notch and extending lengthwise substantially the full height thereof, at which the divider member can be broken to reduce its length.

3. The shelf divider of claim wherein said divider member has opposite front and rear ends, further characterized by:

a substantially flat upright display member on the front end of the divider member, extending laterally across the front end of said partition web.

4. The shelf divider of claim 3, further characterized by:

(1) a substantially horizontal tongue on said divider member, projecting forwardly from the front ends of said supporting flanges and forwardly beyond the front end of said partition web, and (2) said upright display member having a horizontally elongated rearwardly opening groove near its bottom wherein said tongue is snugly received to secure the display member to the divider member.

* * * * *